US005416551A

United States Patent [19]

Ishikawa et al.

[11] Patent Number: 5,416,551

[45] Date of Patent: May 16, 1995

[54] REPLENISHER SUPPLY APPARATUS FOR PHOTOSENSITIVE MATERIAL PROCESSOR

[75] Inventors: Takatoshi Ishikawa; Ken Kawada, both of Kanagawa, Japan

[73] Assignee: Fuji Photo Film Co., Ltd., Kanagawa, Japan

[21] Appl. No.: 128,142

[22] Filed: Sep. 29, 1993

[30] Foreign Application Priority Data

Sep. 30, 1992 [JP] Japan ..... 4-261781

[51] Int. Cl.[6] ..... G03D 3/02

[52] U.S. Cl. ..... 354/298; 354/324

[58] Field of Search ..... 354/324, 298, 322, 323; 134/64 R, 64 P, 122 P, 122 R

[56] References Cited

U.S. PATENT DOCUMENTS 4,103,358 7/1978 Gacki et al. ..... 354/323 X

FOREIGN PATENT DOCUMENTS 53-108335 8/1978 Japan .

645562 3/1989 Japan .

*Primary Examiner*—D. Rutledge

*Attorney, Agent, or Firm*—Sughrue, Mion, Zinn, Macpeak and Seas

[57] ABSTRACT

A replenisher supply apparatus for photosensitive material processor is provided, which includes a cartridge, a replenisher stock tank, a sensor for detecting a solution level of the replenisher in the replenisher stock tank, and a flow means for causing the replenisher to flow from the cartridge mounted on the mount portion to the replenisher stock tank when the sensor detects that the solution level is at a predetermined value or below. As a result, even if the replenisher in the replenisher stock tank runs short during the process, the process can be continued without immediate replacement of the cartridge.

16 Claims, 10 Drawing Sheets

REPLENISHER SUPPLY APPARATUS FOR PHOTOSENSITIVE MATERIAL PROCESSOR

BACKGROUND OF THE INVENTION

1. Field of the Invention

The present invention relates to a replenisher solution supply apparatus for a photosensitive material processor, and more particularly, to a replenisher solution supply apparatus for supplying a replenisher to a processing tank of a photosensitive material processor such as a film processor, a printer processor, and a like.

2. Description of the Related Art

When a photosensitive material such as a film or a photographic printing paper is exposed and then developed, the photosensitive material is conveyed to a series of processing tanks each of which stock a processing solution.

As the photosensitive material is being developed, the processing solutions stocked in these processing tanks adheres to the photosensitive material and thereby consumed. In addition, the processing solutions are oxidized by air and become fatigued. Thus, the replenishing solutions with the same compositions or more active compositions as or than those stocked in the processing tanks must be supplied.

Generally, a replenisher is produced by mixing a condensed solution with water. The produced replenisher is stocked in a replenishing tank. The replenisher stocked in the replenishing tank is supplied to a processing tank by a pump or the like. However, the process for producing a replenisher and stocking it in a replenishing tank is troublesome. Thus, improper replenishing solutions are often produced in an incorrect manner. To prevent such a problem, a cartridge type supply apparatus has been proposed in Japanese Patent Application Laid-Open No. 64-55562). In the cartridge type supply apparatus, an old cartridge is replaced with a new cartridge in which a replenisher is stocked. The replenisher is supplied from the cartridge to a processing tank by a pump or the like.

However, in this cartridge type supply apparatus, when the old cartridge is removed and replaced with the new cartridge and then a solution delivery pipe is inserted into the new cartridge, it is necessary to prevent replenisher which remains in the solution delivery pipe from spilling on the floor. In addition, since the replenisher is pumped up by the pump or the like, the pump occasionally does not pump sufficiently, thereby stopping the supply of the replenisher.

In a supply apparatus which has a structure for preventing a replenisher from leaking out of a delivery pipe when replacing an old cartridge with a new cartridge, the supply of the replenisher in the new cartridge is troublesome or requires a special operation (as disclosed in Japanese Utility Model Application Laid-Open No. 53-108335).

In these related art references, when an old cartridge is replaced with a new cartridge which stocks a replenisher, a sensor which detects whether or not the cartridge in use is empty is used. When the cartridge becomes empty, an alarm is activated. Thus, when the cartridge in use becomes empty, even if the process is being performed, the alarm is activated signifying that the empty cartridge must be immediately replaced with a new one. The process must therefore be suspended.

The present invention is made to solve such problems.

SUMMARY OF THE INVENTION

An object of the present invention is to provide a replenisher solution supply apparatus for a photosensitive material processor which automatically supplies a replenisher to a replenisher stock portion even if the replenisher in the stock portion runs out while the processor is operating. Thus, without necessity of replacing a cartridge, the operation of the processor can be continued.

A first aspect of the present invention is a replenisher solution supply apparatus for a photosensitive material processor, comprising a cartridge for stocking a replenisher, a replenisher stock tank having a mount portion for mounting the cartridge and being adapted for stocking the replenisher to be supplied to a processing tank, a sensor for detecting a solution level of the replenisher in the replenisher stock tank, and a flow means for causing the replenisher to flow from the cartridge mounted on the mount portion to the replenisher stock tank when the sensor detects that the solution level is at a predetermined value or below.

According to the first aspect of the present invention, the cartridge of the replenisher solution supply apparatus has a meltable portion. When the sensor detects that the solution level is at a predetermined value or below, the flow means preferably melts the meltable portion of the cartridge mounted on the mount portion so as to cause the replenisher in the cartridge to flow into the replenisher stock tank. Thus, even if the replenisher stock tank runs out of the replenishing tank, the replenisher can be automatically supplied to the replenisher stock tank. Thus, without necessity of immediately replacing the cartridge, the process can be continued.

A second aspect of the present invention is a replenisher solution supply apparatus for a photosensitive material processor, comprising a cartridge for stocking a replenisher, a replenisher stock tank having a mount portion for mounting the cartridge and being adapted for stocking the replenisher to be supplied to a processing tank, a connection means for connecting the cartridge mounted on the mount portion and the replenisher stock tank, a valve disposed at the connection means, a sensor for detecting a solution level of the replenisher in the replenisher stock tank, and a flow means for causing the valve to open and the replenisher to flow from the cartridge mounted on the mounting portion to the replenisher stock tank through the connection means when the sensor detects that the solution level is at a predetermined value or below.

In other words, according to the second aspect of the present invention, the mount portion has a connection means which connects the cartridge mounted on the mount portion and the replenisher stock tank. The connection means has a valve. When the solution level of the replenisher stocked in the replenisher stock tank is at a predetermined value or below, the flow means opens the valve so as to cause the replenisher to flow into the replenisher stock tank through the connection means.

According to the second aspect of the present invention, the flow means preferably has a pipe which causes the replenisher in the cartridge to flow to the bottom of the replenisher stock tank. In addition, the replenisher stock tank preferably has a float means which floats on the replenisher and is adapted to decrease the contact area of the replenisher with air. When the sensor detects the solution level of the replenisher in the replenisher stock tank, a valve in the connection means is opened so as to cause the replenisher in the cartridge to flow to the stock tank through the pipe. Thus, the float means prevents the replenisher supplied to the replenisher stock tank from being deteriorated by air.

A third aspect of the present invention is a replenisher solution supply apparatus for a photosensitive material processor, comprising a cartridge having a hole-producible portion and being adapted for stocking a replenisher, a replenisher stock tank having a mount portion for mounting the cartridge and being adapted for stocking the replenisher to be supplied to a processing tank, a sensor for detecting a solution level of the replenisher in the replenisher stock tank, and a flow means for producing a hole in the hole-producible portion of the cartridge mounted on the mount portion and causing the replenisher to flow from the cartridge mounted on the mounting portion to the replenisher stock tank when the sensor detects that the solution level is at a predetermined value or below.

In other words, according to the third aspect of the present invention, the cartridge has a hole-producible portion. When the sensor does not detect that the solution level is at a predetermined value or below, the flow means produces a hole in the hole-producible portion so as to cause the replenisher stocked in the cartridge to flow into the replenisher stock tank.

According to the third aspect of the present invention, the flow means preferably has a link mechanism and an actuator. The link mechanism has a cylindrical-hole-producing blade. The actuator drives the link mechanism. The hole-producing blade is moved by the actuator so as to produce a hole in a hole producible portion. When the sensor detects the solution level of the replenisher in the replenisher stock tank, the actuator moves the hole-producing blade via the link mechanism so as to produce a hole in the hole producible portion of the cartridge and automatically supply the replenisher to the replenisher stock tank.

As described above, when the solution level of the replenisher stock tank becomes a predetermined value or below, the replenisher stocked in the cartridge is supplied to the replenisher stock tank. Thus, even if the replenisher stock tank runs out of the replenisher while the process is being performed, without necessity of the cartridge, the process can be continuously performed.

In the flow means, a pipe which causes the replenisher stocked in the cartridge to flow to the bottom of the replenisher stock tank can be disposed. Thus, when the replenisher is supplied, the replenisher is unlikely to adhere to and deposit on the side wall and so forth of the replenisher stock tank.

When a float means which floats on the solution surface of the replenisher and thereby decreases the contact area of the replenisher with air is used, the deterioration of the replenisher by oxidization can be minimized.

As a practical float means, a floating ball or a floating plate may be used. The aperture (opening area $cm^2$/solution volume $cm^3$) of the replenisher tank is preferably 0.05 or below, most preferably 0.02 or below.

As described above, according to the present invention, when the solution level of the replenisher stocked in the replenisher stock tank becomes a predetermined value or below, the replenisher is automatically supplied from the cartridge to the replenisher stock tank. Thus, even if the replenisher stock tank runs out of the replenisher during the process, unlike with the conventional apparatuses, it is not necessary to immediately replace the empty cartridge with a new one. Thus, since the process can be continued without suspension, the operability is improved.

When the flow means is provided with a connection means, the replenisher is supplied through the connection means. Thus, the replenisher can be prevented from adhering to and depositing on the inner wall of the replenisher stock tank.

When a float means, which floats on the surface of the replenisher and reduces the contact area of the replenisher with air, is disposed in the replenisher stock tank, oxidization of the replenisher can be minimized. Thus, the service life of the replenisher can be prolonged.

These and other objects, features and advantages of the present invention will become more apparent in light of the following detailed description of best mode embodiments thereof, as illustrated in the accompanying drawings.

DETAILED DESCRIPTION OF PREFERRED EMBODIMENTS

Figure 1:
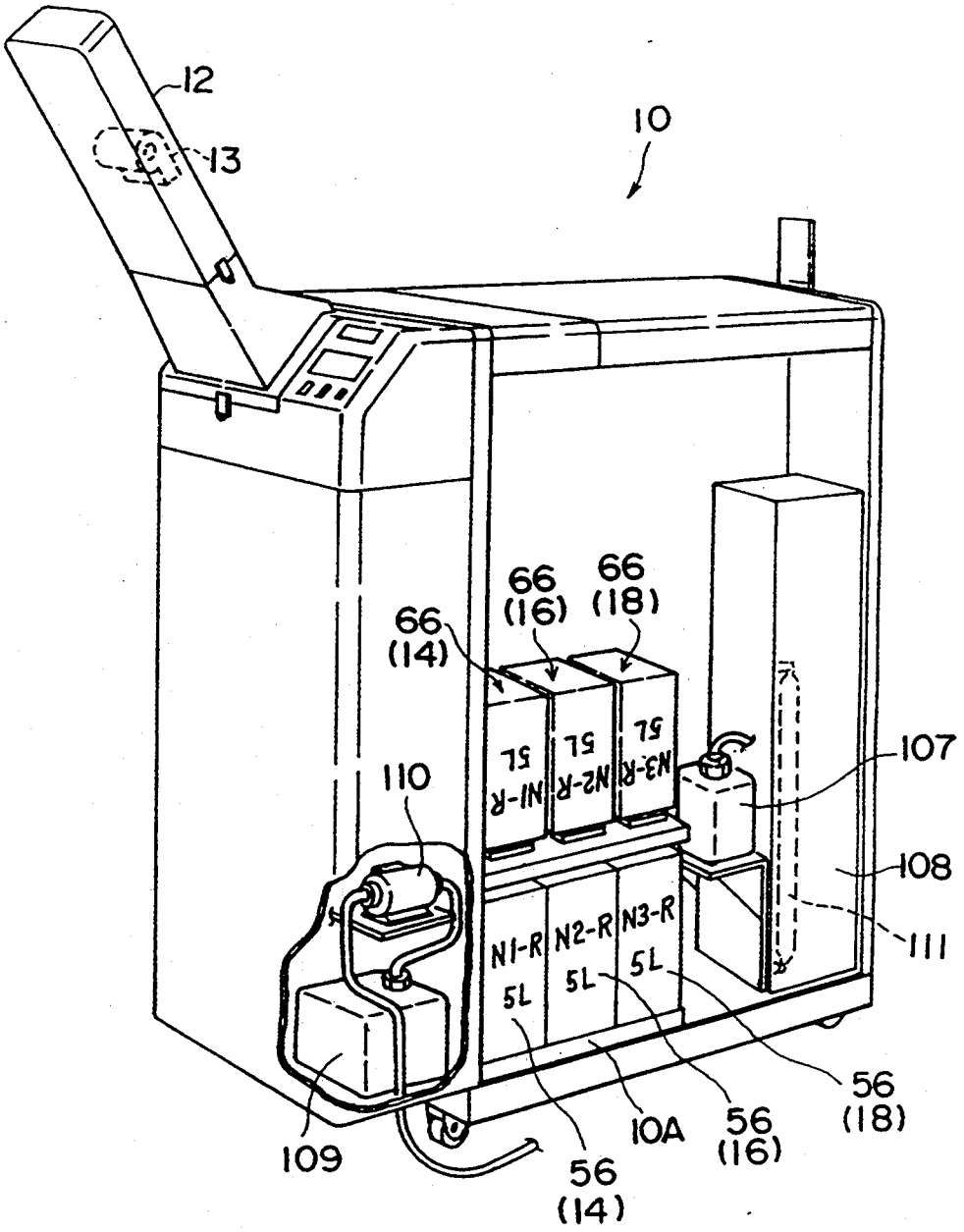
FIG. 1 is a perspective view showing a film developing machine according to the present invention.

Examples of the material of the cartridge according to the present invention may be paper, plastic, and metal. In these examples, a plastic material with an oxygen permeable coefficient of 50 ml/($m^2$ atm/*4/-day) is preferable.

The oxygen permeable coefficient may be measured according to a method described in "$O_2$ Permeation of Plastic Container", MODERN PACKING, N. J. Calyan, pp. 143–145, DECEMBER, 1968.

Examples of preferable plastic materials are polyvinyliden chloride (PVDC), nylon (NY), polyethylene (PE), polypropylene (PP), polyester (PES), ethylene-vinylacetate copolymer (EVA), ethylene-vinylalcohol copolymer (EVAL), polyacrylonitrile (PAN), polyvinylalcohol (PVA), and polyethylenetelephthalate (PET).

In the present invention, so as to reduce the oxygen permeable coefficient, PVDC, NY, PE, EVA, EVAL, and/or PET is preferable.

These materials may be used as a single material, molded, or laminated (as a so-called lamination film). Examples of the shape of the cartridge are a bottle type, a cubic type, and a pillow type. In the present invention, the shape of the cartridge is most preferably a cubic type or the like which is flexible and easy-to-use. In other words, as the content of the solution stocked in the cubic-shaped cartridge decreases, the outer volume thereof also decreases.

In addition, examples of compositions of lamination films as the material of the cartridge are as follows. However, the material of the cartridge according to the present invention is not limited to these laminate films.

- PE/EVAL/PE
- PE/aluminum foil/PE
- NY/PE/NY
- NY/PE/EVAL
- PE/NY/PE/EVAL/PE
- PE/NY/PE/PE/PE/NY/PE
- PE/$SiO_2$ film/PE
- PE/PVDC/PE
- PE/NY/aluminum foil/PE
- PE/PP/aluminum foil/PE
- NY/PE/PVDC/NY
- NY/EVAL/PE/EVAL/NY
- NY/PE/EVAL/NY
- NY/PE/PVDC/NY/EVAL/PE
- PP/EVAL/PE
- PP/EVAL/PP
- NY/EVAL/PE
- NY/aluminum foil/PE
- Paper/aluminum foil/PE
- Paper/PE/aluminum foil/PE
- PE/PVDC/NY/PE
- NY/PE/aluminum foil/PE
- PET/EVAL/PE
- PET/aluminum foil/PE
- PET/aluminum foil/PET/PE The thicknesses of these laminate films are in the range from 5 to 1500/*1/m, preferably in the range from 10 to 1000/*1/m.

The content of the cartridge is in the range from 100 ml to 20 liters, preferably in the range from 500 ml to 10 liters.

The cartridge may be encased in an outer box made of corrugated cardboard or plastic. In addition, the cartridge may be integrally formed along with the outer box.

The cartridge according to the present invention may be replenished with a variety of processing solutions. Examples of the processing solutions are a color developing solution, a monochrome developing solution, a bleaching solution, a conditioner, a revere developing solution, a fixing solution, a bleaching and fixing solution, and a stabilizing solution. For a cartridge with a low oxygen permeable coefficient, a color developing solution, a monochrome developing solution, a fixing solution, or a bleaching and fixing solution is preferably used.

The present invention can be applied to various processing solutions.

The color developing solution is preferably an alkaline solution whose main component is an aromatic primary amine type color developing agent. As the color developing agent, an aminophenol type compound may be used. A p-phenylenediamine type compound is preferably used. Examples of the p-phenylenediamine type compounds are 3-methyl-4-amino-N,N-di-ethylaniline, 4-amino-N-ethyl-N-/*2/-hydroxyethylaniline, 3-methyl-4-amino-N-ethyl-N-/*2/-hydroxyethylaniline, 3-methyl-4-amino-N-ethyl-N-/*2/-methanesulfonicamidethylaniline, 3-methyl-4-amino-N-ethyl-N-/*2/-methoxylethylaniline, 3-methyl-4-amino-N-ethyl-N-/*3/-hydroxybutylaniline, sulfates thereof, hydro-chlorides thereof, and p-toluenesulfides thereof. When necessary, two or more of these compounds may be used in combination.

The material of the color developing solution usually contains a pH buffer (such as a carbonate, a borate, or a phosphate of an alkali metal) and a development restrainer or an antifoggant (such as a bromide salt, an iodide salt, a benzimidazole type, a benzothiazole type, or a mercapto compound). When necessary, the color developing solution may contain a preservative (such as hydroxylamine, N,N-di-(sulfo-ethyl) hydroxylamine, diethylhydroxylamine, sulfite, hydrazine type, phenylsemicarbazide type, triethanolamine, or catechol-disulfonic acid type), an organic solvent (such as ethyleneglycol or diethyleneglycol), a developing accelerator (such as benzylalcohol, polyethyleneglycol, tetraalkylammonium salt, or amine type), a fogging agent (such as a dye forming coupler, a competing coupler, or sodiumboronhydride), an auxiliary developing agent (such as 1-phenyl-3-pyrazolidone), a viscous additive, and a chelate agent (such as amino-polycarboxylic acid, aminopolyphosphoric acid, alkylhosphonic acid, or phosphonocarboxylic acid). For example, ethylendiaminetetraacetic acid, nitrilotriacetic acid, diethylenetriaminepentaacetic acid, cyclohexanediaminetetraacetic acid, hydroxyethyliminodiacetic acid, 1-hydroxyethyelidene-1,1-diphosphonic acid, nitro-N,N,N-trimethylenephosphonic acid, ethylenediamine-N,N,N',N'-tetramethylenephosphonic acid, ethylenediamine-di (o-hydroxyphenylacetic acid), or a salts thereof may be used.

The pH of these materials of the color developing solution is normally in the range from 9 to 12.

The replenishing amount of the developing solution is normally one liter per $m^2$ or less although it depends on the color photosensitive material for use. When the ion concentration of bromide in the replenisher is decreased, the replenishing amount of the developing solution can be decreased to 300 ml or less. The replenishing amount of the developing solution is preferably in the range from 30 ml/$m^2$ to 150 ml/$m^2$. When the replenishing amount of the color developing solution is decreased, the contact area of the processing tank with air is preferably decreased so as to prevent the solution from evaporating and being oxidized by the air. In addition, when a means for suppressing accumulation of bromide ions in the developing solution is used, the replenishing amount of the developing solution can be decreased.

After the color developing step is completed, a photographic emulsion layer of the photosensitive material is normally bleached. The bleaching step may be performed when a fixing step is performed (as a bleaching and fixing step). Alternatively, the bleaching step may be independently performed. To speed up the process, the bleaching step may be followed by the bleaching and fixing step. In addition, the bleaching and fixing step may be performed in two successive bleaching and fixing baths. Moreover, the fixing step may be followed by the bleaching and fixing step. Furthermore, the bleaching and fixing step may be followed by the bleaching step. One of these methods may be selected corresponding the application to be used. Examples of the material of the bleaching agent are a compound of a multi-charged metal (such as iron (III), cobalt (III), chrome (VI), or copper (II)), peroxide type, quinone type, and nitro compound. Typical examples of the bleaching agent are ferricyanide, dichromate, an organic complex salt of iron (III) or cobalt (III) [such as a polycarboxylic acid type, (for example ethylenediaminetetraacetic acid, diethylenetriaminetetraacetic acid, cyclohexanediaminetetraacetic acid, methyliminodiacetic acid, 1,3-diaminopropanetetraacetic acid, or glycoletheldiaminetetra-acetic acid) or complex salt (for example, citric acid, tartaric acid, or malic acid), persulfaric acid, bromate, permanganic acid, or nitrobenzene type. In these examples, the ethylenediaminetetraacetic acid iron (III) complex salt, aminopolycarboxyl iron (III) complex salt, and persulfaric acid are preferable from viewpoints of speed of process and ecologic preservation. In addition, the aminopolycarboxyl iron (III) complex salt is very useful as a bleaching solution and the bleaching and fixing solution. Although the pH of the bleaching solution or the bleaching and fixing solution using the aminopolycarboxylic iron (III) complex salt is normally in the range from 4.5 to 8, these solutions may be processed at a lower pH so as to speed up the process.

When necessary, for the bleaching solution, the bleaching and fixing solution, and prebaths thereof, a bleaching accelerator may be used. Practical and effective examples of a bleaching accelerator are compounds having a mercapto group or disulfide coupling which are disclosed in U.S. Pat. No. 3,893,858, West Germany Patent No. 1,290,812, Japanese Patent Application Laid-Open No. 53-95630, Research Disclosure No. 17129 (July, 1978); a thiazolidine derivative disclosed in Japanese Patent Application Laid-Open No. 50-140129; a thiourea derivative disclosed in U.S. Pat. No. 3,706,561; an iodide salt disclosed in Japanese Patent Application Laid-Open No. 58-16235; polyoxyethylen compounds disclosed in West Germany Patent No. 2,748,430; a polyamine compound disclosed in Japanese Patent Application Publication No. 45-8836; and bromide ions. In these examples, compounds having a mercapto group or a disulfide group are preferable because they have many accelerating effects. In particular, the compounds disclosed in U.S. Pat. No. 3,893,858, West Germany Patent No. 1,290,812, and Japanese Patent Application Laid-Open No. 53-95630 are preferable. In addition, the compounds disclosed in U.S. Pat. No. 4,552,834 is preferable. These examples of the bleaching accelerator may be added to a photosensitive material. When a color photosensitive material is bleached and fixed, these examples of the bleaching accelerator are very effective.

Examples of the material of the fixing agent are thiosulfate, thiocyanate, thioether type compound, thiourea type, various iodide salts. In these examples, the thiosulfate is normally used. In particular, ammonium thiosulfate can be most widely used. Preferable examples of a preservative of the bleaching and fixing solution are sulfite, hydrogensulfite, benzensulfonic acid type, and additive of carbonyl bisulfite.

After a desilvering step, a washing step or a stabilizing step is normally performed. The amount of washing water in the washing step depends on the characteristics (for example, coupler) of the photosensitive material, the application, the temperature of washing water, the number of washing tanks (the number of stages), the replenishing type (countercurrent contacting type, down-flow type, and the like), and other conditions. The relation between the number of washing tanks in multiple-staged countercurrent contacting-type system and the amount of water can be obtained by a method described in JOURNAL OF THE SOCIETY OF MOTION PICTURE AND TELEVISION ENGINEERS, PP. 248–253, MAY, 1955, VOL. 64.

According to the multi-staged countercurrent contacting system described in the above-described paper, the amount of washing water can be remarkably decreased. However, since water stays in a tank for a long time, bacterium increasingly grow and thereby floating substances adhere to the photosensitive material. In the processing of color photosensitive material according to the present invention, the growth of bacterium can be prevented by a method disclosed in Japanese Patent Application Laid-Open No. 62-288838. In this method, calcium ions and magnesium ions are reduced. In addition, an isothiazolone compound disclosed in Japanese Patent Application Laid-Open No. 57-8542; a cyabendazole type, chlorine type insecticides such as chlorinated isocyanuric acid, and other benzotriazole may be used. These insecticides are described in "Chemistry of Bacteria and Mildew Proofing Agents (Translated Title)", by Hiroshi Horiguchi, "Bacteria Sterilizing and Mildew Proofing Techniques" by Hygiene Engineering Association, and "Dictionary of Bacteria and Mildew Proofing Agents" by NIPPON BACTERIUM AND MILDEW PROOFING ASSOCIATION.

The pH of the washing water for use in the process of the photosensitive material according to the present invention is in the range from 4 to 9, preferably in the range from 5 to 8. The temperature of the washing water and the washing period of time depend on the characteristics and application of the photosensitive material. They are normally in the range from 20 sec. to 10 min. at temperatures from 15° to 45° C., preferably in the range from 30 sec. to 5 min. at temperatures from 25° to 40° C. In the photosensitive material according to the present invention, it may be processed with a stabilizing solution without the washing step. In the stabilizing step, known methods disclosed in Japanese Patent Application Laid-Open Nos. 57-8543, 58-14834, and 60-220345 may be used.

Various chelate agents and mildew proofing agents may be used for the stabilizing bath.

Overflow solutions which take place in performing the washing step or replenishing the stabilizing solution may be used in other steps such as desilvering step.

Figure 2:
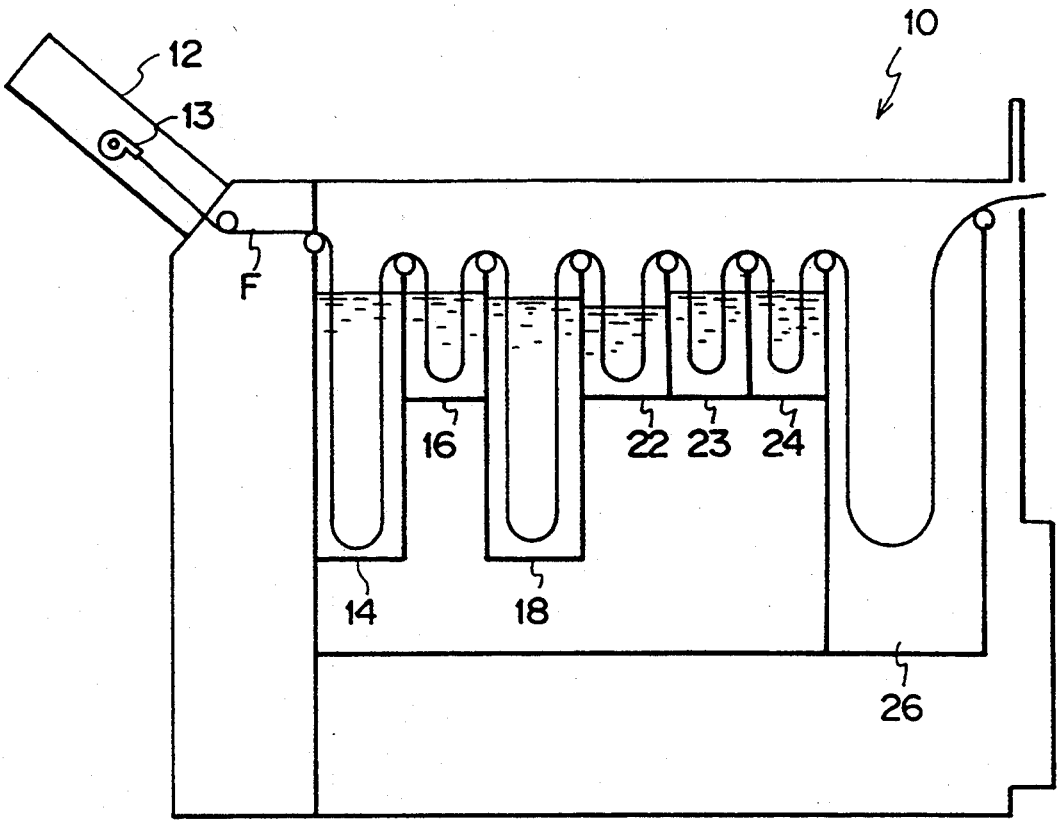
FIG. 2 is a longitudinal sectional view of FIG. 1.

Next, with reference to the accompanying drawings, embodiments of the present invention will be described in detail. FIGS. 1 and 2 show a film developing apparatus (a film processor) 10 according to a first embodiment of the present invention. In the film developing apparatus 10, a negative film F is removed from a film cartridge (Patrone) 13. The removed film F is conveyed to a color developing tank 14, a bleaching tank 16, a fixing tank 18, rinsing tanks 22 and 23, and a stabilizing tank 24 in succession. Thus, a sequence of developing steps are performed for the film F. Thereafter, the film F is conveyed to a drying portion 26 so as to dry the film F. In these processing tanks, respective pre-mixed processing solutions are stocked.

Figure 3:
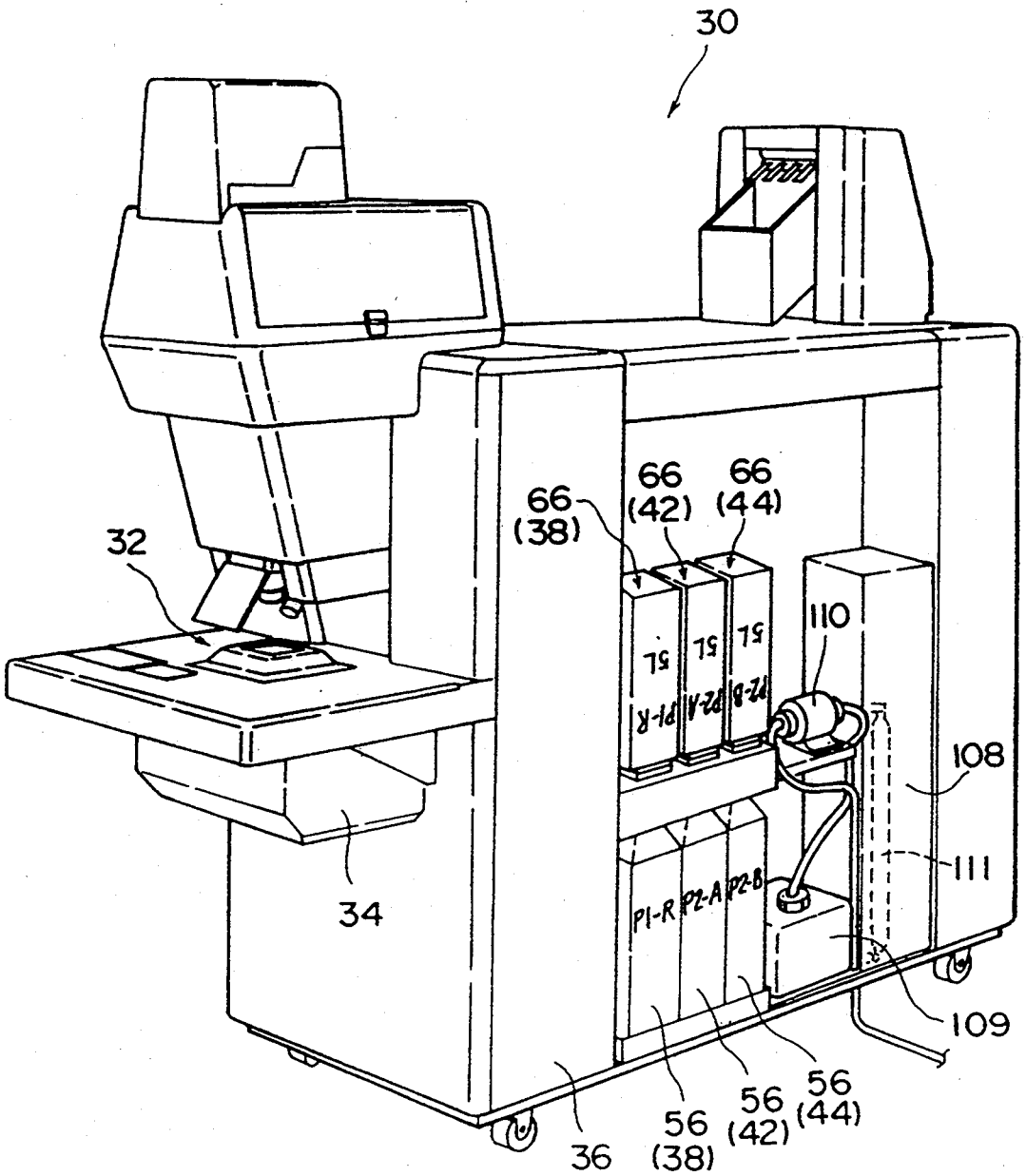
FIG. 3 is a perspective view showing a photographic paper printing and developing apparatus according to the present invention.
Figure 4:
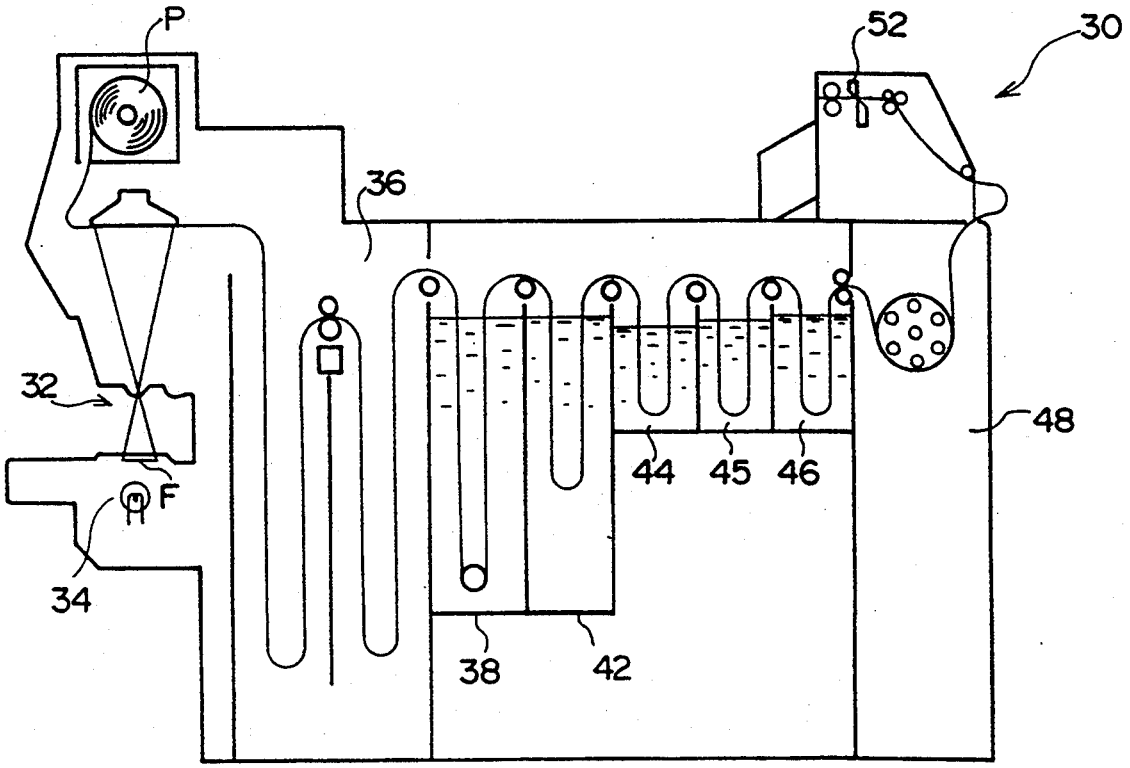
FIG. 4 is a longitudinal sectional view of FIG. 3.

FIGS. 3 and 4 show a photographic paper printing and developing apparatus (a printer processor) 30 according to the present invention. In the photographic paper printing and developing apparatus 30, a photographic paper P which is wound in a roll shape is conveyed to a printing portion 32. The printing portion 32 prints an image on the negative film F with light irradiated from a light source 34. Then, the photographic paper P is conveyed to a paper reservoir portion 36. Thereafter, the photographic paper P is conveyed to a color developing tank 38, a bleaching and fixing tank 42, and rinsing tanks 44, 45, and 46 in succession. Thus, a sequence of developing processes are performed on the photographic paper P. Thereafter, the photographic paper P is conveyed to a drying portion 48. The drying portion 48 dries the photographic paper P. The dried photographic paper P is cut image by image by a cutter 52.

In these processing tanks, pre-mixed processing solutions (such as a developing solution, a bleaching solution, a fixing solution, a bleaching and fixing solution, and a stabilizing solution) are respectively stocked.

The processing conditions of the film processor and examples of the processing solutions are given.

(Processing Method)

| Step Temperature | Processing Period of Time | Processing |
|---|---|---|
| Color developing | 3 min. 15 sec. | 38° C. |
| Bleaching | 1 min. 00 sec. | 38° C. |
| Bleaching and fixing | 3 min. 15 sec. | 38° C. |
| Rinsing (1) | 40 sec. | 35° C. |
| Rinsing (2) | 1 min. 00 sec. | 35° C. |
| Stabilizing | 40 sec. | 38° C. |
| Drying | 1 min. 15 sec. | 55° C. |

Next, the compositions of the processing solutions are given.

| (Color Developing Solution) | (Unit: g) |
|---|---|
| Diethylenetriaminepentaacetic acid | 1.0 |
| 1-hydroxyehylidene-1,1-diphosphonic acid | 2.0 |
| Sodium sulfite | 4.0 |
| Potassium carbonate | 30.0 |
| Potassium bromide | 1.4 |
| Potassium iodide | 1.5 mg |
| Hydroxyaminesulfate | 2.4 |
| 4-[N-ethyl-N-(/*2/-hydroxyethyl) amino]-2-methylanylinesulfate] | 4.5 |
| Water added | 1.0 liter |
| pH (adjusted with potassium hydroxide and sulfuric acid) | 10.05 g |

| (Bleaching Solution) | (Unit: g) |
|---|---|
| Iron (III) ammonium ethylenediamine-tetraacetic acid dihydride | 120.0 |
| Disodium ethylenediaminetetraacetate | 10.0 |
| Ammonium bromide | 100.0 |
| Ammonium sulfate | 10.0 |
| Bleaching accelerator $(CH_3)_2N—CH_2—CH_2—S—S—CH_2—CH_2—N(CH_3)_2$/*4/2HCl | 0.005 mol. |
| Ammonium solution (27%) | 15.0 ml |
| Water added | 1.0 liter |
| pH (modified with ammonium solution and nitric acid) | 6.3 |

| (Bleaching and Fixing Solution) | (Unit: g) |
|---|---|
| Iron (III) ammonium ethylenediaminetetraacetate dihydrate | 50.0 |
| Disodium ethylenediaminetetraacetate | 5.0 |
| Sodium sulfite | 12.0 |
| Ammonium thiosulfate solution (700 g/liter) | 240.0 ml |
| Ammonium solution (27%) | 6.0 ml |
| Water added | 1.0 liter |
| pH (modified with ammonium solution and acetic acid) | 7.2 |

(Washing Water)

Tap water was passed through a mixed-bed system. The mixed-bed system was filled with an H type strong acid cationic exchange resin (Rohm & Haas Co., "AMBERLITE IR- 120B") and an OH type anionic exchange resin (Rohm & Haas Co., "AMBERLITE IR-400"). In the mixed-bed system, the concentrations of calcium ions and magnesium ions of the tap water were decreased to 3 mg/l or below. Next, 20 mg/l of sodium isocyanuric acid dichloride and 0.15 g/l of sodium sulfate were added to the resultant water. The pH of the resultant water was in the range from 6.5 to 7.5.

| (Stabilizing Solution) | (Unit: g) |
|---|---|
| p-sodiumtoluensulfonate | 0.03 |
| Polyoxyethylene-p-monononylphenylether (average polymerization degree: 10) | 0.2 |
| Disodium ethylenediaminetetraacetate | 0.05 |
| 1,2,4-triazole | 1.3 |
| 1,4-bis(1,2,4-triazole-1-ilmethyl) piperazine | 0.75 |
| Water added | 1.0 liter |
| pH | 8.5 |

Another example of the processing conditions of the film processor and processing solution thereof are given in the following.

(Processing Steps)

| Step | Processing Period of Time | Processing Temperature | Replenishing Amount |
|---|---|---|---|
| Color developing | 3 min. 15 sec. | 37.8° C. | 20 ml |
| Bleaching | 45 sec. | 38.0° C. | 5 ml |
| Fixing (1) | 45 sec. | 38.0° C. | — |
| Fixing (2) | 45 sec. | 38.0° C. | 30 ml |
| Stabilizing (1) | 20 sec. | 38.0° C. | — |
| Stabilizing (2) | 20 sec. | 38.0° C. | — |
| Stabilizing (3) | 20 sec. | 38.0° C. | 40 ml |
| Drying | 1 min. | 55° C. | |

* The replenishing amount is for 35 mm wide, 1.1 m long (equivalent to one 24-exposure film).
* The fixing steps are countercurrent contacting type from fixing step (2) to fixing step (1).
* The stabilizing steps are countercurrent contacting type from stabilizing step (2) to stabilizing step (1).

The amount of developing solution which is brought to the bleaching step along with the photosensitive material is 2.5 ml (when the width and length of the photosensitive material are 35 mm and 1 m, respectively). The amount of fixing solution which is brought to the stabilizing step along with the photosensitive material is 2.0 ml (when the width and length of the photosensitive material are 35 mm and 1 m, respectively).

Next, the compositions of the processing solutions are given.

| (Color Developing Solution) | Tank Solution (g) | Replenisher (g) |
|---|---|---|
| Diethyelentriamine-pentaacetate | 5.0 | 6.0 |
| Sodium sulfite | 4.0 | 5.0 |
| Potassium carbonate | 30.0 | 37.0 |
| Potassium bromide | 1.3 | 0.5 |
| Potassium iodide | 1.2 mg | — |
| Hydroxylamine sulfate | 2.0 | 3.6 |
| 4-[N-ethyl-N-(/*2/-hydroxyethyl) amino]-2-methyl-aniline sulfate | 4.7 | 6.2 |
| Water added | 1.0 liter | 1.0 liter |
| pH (modified with hydroxide and sulfuric acid) | 10.00 | 10.15 |

| (Bleaching Solution) | Tank Solution (g) | Replenisher |
|---|---|---|
| 1,3-Iron (III) ammonium diaminopropanetetra-acetate monohydrate | 144.0 | 206.0 |
| 1,3-diaminopropane-tetraacetate | 2.8 | 4.0 |
| Ammonium bromide | 84.0 | 120.0 |
| Ammonium nitrate | 17.5 | 25.0 |
| Ammonium solution (27%) | 10.0 | 1.8 |
| Acetic acid (98%) | 51.1 | 73.0 |
| Potassium carbonate | 10.0 | — |
| Water added | 1.0 liter | 1.0 liter |
| pH (modified with ammonium solution and acetic acid) | 4.3 | 3.4 |

(Fixing Solution) Both tank solution and replenisher (Unit: g)

| | |
|---|---|
| Disodium ethylendiamine-tetraacetate | 1.7 |
| Sodium sulfite | 14.0 |
| Heavy sodium sulfite | 10.0 |
| Ammonium thiosulfate solution (700 g/liter) | 210.0 ml |
| Ammonium thiocyanate | 163.0 |
| Thiourea | 1.8 |
| Water added | 1.0 liter |
| pH | 6.5 |

(Stabilizing Solution) Both tank solution and replenisher (unit: g)

| | |
|---|---|
| Surface active agent $[C_{10}H_{21}—O—(CH_2CH_2O)_{10}—H$ | 0.2 |
| Polymaleic acid (average molecular weight: 2000) | 0.1 |
| 1,2-benzisothiazolin-3-one | 0.05 |
| Hexamethylenetetramine | 5.5 |
| Water added | 1.0 liter |
| pH | 8.5 |

An example of the processing conditions and processing solutions of the processing steps of the printer processor is given in the following.

| Processing Step | Temp. | Period of Time | Replenishing Tank Amount* | Replenishing Tank Volume |
|---|---|---|---|---|
| Color developing liters | 38.5° C. | 45 sec. | 73 ml | 20 |
| Bleaching and fixing liters | 35° C. | 45 sec. | 60 ml | 20 |
| Rinsing (1) | 35° C. | 30 sec. | — | 10 |

-continued

| Processing Step | Temp. | Period of Time | Replenishing Tank Amount* | Replenishing Tank Volume |
|---|---|---|---|---|
| liters | | | | |
| Rinsing (2) liters | 35° C. | 30 sec. | — | 10 |
| Rinsing (3) liters | 35° C. | 30 sec. | 360 ml | 10 |
| Drying | 80° C. | 60 sec. | | |

* Replenishing amount is for photosensitive material per 1 $m^2$.

** 120 ml of water per 1 $m^2$ of photosensitive material is added in the rinsing step (1) along with 60 ml of replenishing amount.

(The rinsing steps are per formed by countercurrent contacting system using three rinsing tanks (3) to (1) in this order.)

The compositions of the processing solutions are given in the following.

| [Color developing solution] | [Tank solution] | [Replenisher] |
|---|---|---|
| Water | 800 ml | 800 ml |
| Ethylenediaminetetraacetate | 3.0 g | 3.0 g |
| 4,5-dihydroxybenzine-1,3-disulfonyldisodium salt | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent whitening agent (SUMITOMO CHEMICAL CO., LTD., WHITEX 4) | 1.0 g | 3.0 g |
| Sodium sulfite | 0.1 g | 0.1 g |
| Disodium-N,N-bis(sulfonateethyl) hydroxylamine | 5.0 g | 10.0 g |
| Triisopropylnaphthalene(/*2/)-sulfonylsodium | 0.1 g | 0.1 g |
| N-ethyl-N-(/*2/-methanesulfonyl-amideethyl)-3-methyl-4-aminoaniline/*4/3/2 sulfuric acid/*4/monohydrate | 5.0 g | 11.5 g |
| Water added | 1000 ml | 1000 ml |
| pH (modified with potassium hydroxide and sulfuric acid at 25° C.) | 10.00 | 11.00 |

| [Bleaching and Fixing] | [Tank Solution] | [Replenisher] |
|---|---|---|
| Water | 600 ml | 150 ml |
| Ammonium thiosulfate solution (700 g/liter) | 100 ml | 250 ml |
| Ammonium sulfite | 40 g | 100 g |
| Iron (III) ammonium ethylenedi-aminetetraacetate | 55 g | 135 g |
| Ethylenediaminetetraacetate-iron | 5 g | 12.5 g |
| Ammonium bromide | 40 g | 75 g |
| Nitric acid (67%) | 30 g | 65 g |
| Water added | 1000 ml | 1000 ml |
| pH (adjusted by acetic acid and ammonium solution at 25° C.) | 5.8 | 5.6 |

[Rinsing Solution] (Both tank solution and replenisher)

| | |
|---|---|
| Sodium chloroisocyanurate | 0.02 g |
| Deionized water (electric conductivity rate: 5/*1/s/cm or below) | 1000 ml |
| pH | 6.5 |

Another example of the processing conditions and processing solutions of the processing steps of the printer processor is given in the following.

| Processing Step | Temp. | Period of Time | Replenishing Tank Amount | Replenishing Tank Volume |
|---|---|---|---|---|
| Color developing | 35° C. | 45 sec. | 161 ml | 17 liters |
| Bleaching and fixing | 35° C. | 45 sec. | 215 ml | 17 liters |
| Stabilizing (1) | 35° C. | 20 sec. | — | 10 liters |
| Stabilizing (2) | 35° C. | 20 sec. | — | 10 liters |
| Stabilizing (3) | 35° C. | 20 sec. | — | 10 liters |
| Stabilizing (4) | 35° C. | 20 sec. | 248 ml | 10 liters |
| Drying | 80° C. | 60 sec. | | |

* The replenishing amount is per 1 $m^2$ of photosensitive material.
* The rinsing steps are performed by countercurrent contacting system using four rinsing tanks (4) to (1) in this order.

The compositions of the processing solutions are given in the following.

| [Color developing solution] | [Tank Solution] | [Replenisher] |
|---|---|---|
| Water | 800 ml | 800 ml |
| 1-hydroxythylidene-1,1-diphosphonic acid (60%) | 0.8 ml | 0.8 ml |
| Lithium sulfate (anhydride) | 2.7 g | 2.7 g |
| Triethyanoleamine | 8.0 g | 8.0 g |
| Sodium chloride | 1.4 g | — |
| Potassium bromide | 0.03 g | 0.025 g |
| Diethylhydroxylamine | 4.6 g | 7.2 g |
| Potassium carbonate | 27 g | 27 g |
| Sodium sulfite | 0.1 g | 0.2 g |
| N-ethyl-N-(/*2/-methanesulfonamideethyl)-3-methyl-4-aminoaniline/*4/3/2 sulfuric acid/*4/monohydrate | 4.5 g | 7.3 g |
| Fluorescent whitening agent (4,4'-diaminostilbene type) | 2.0 g | 3.0 g |
| Water added | 1000 ml | 1000 ml |
| pH (potassium hydroxide added) | 10.25 | 10.80 |

[Bleaching and Fixing Solution] (Both tank solution and replenisher)

| | |
|---|---|
| Water | 400 ml |
| Ammonium thiosulfate (700 g/liter) | 100 ml |
| Sodium sulfite | 17 g |
| Iron (III) ammonium ethylenediaminetetraacetate | 55 g |
| Ethylenediaminetetraacetate-disodium | 5 g |
| Glacial acetic acid | 9 g |
| Water added | 1000 ml |
| pH (at 25° C.) | 5.40 |

[Stabilizing solution] (Both tank solution and replenisher)

| | |
|---|---|
| Benzisothiazolin-3-one | 0.02 g |
| Polyvinyl pyrrolidone | 0.05 g |
| Water added | 1000 ml |
| pH | 7.0 |

In FIGS. 1 and 2, reference numeral 66 is a replenisher cartridge. Reference numeral 56 is a replenisher stock tank. Reference numeral 108 is a water stock tank. In the water stock tank 108, an UV sterilizing lamp 111 is disposed. Reference numeral 109 is a waste solution stock tank. Reference numeral 110 is a pump which delivers waste solution. Reference numeral 107 is a concentrated stabilizing solution cartridge.

In each processing tank, a conveying rack which causes the negative film F and the photographic paper P to be properly conveyed is disposed along with a drive device which drives the conveying rack.

Figure 5:
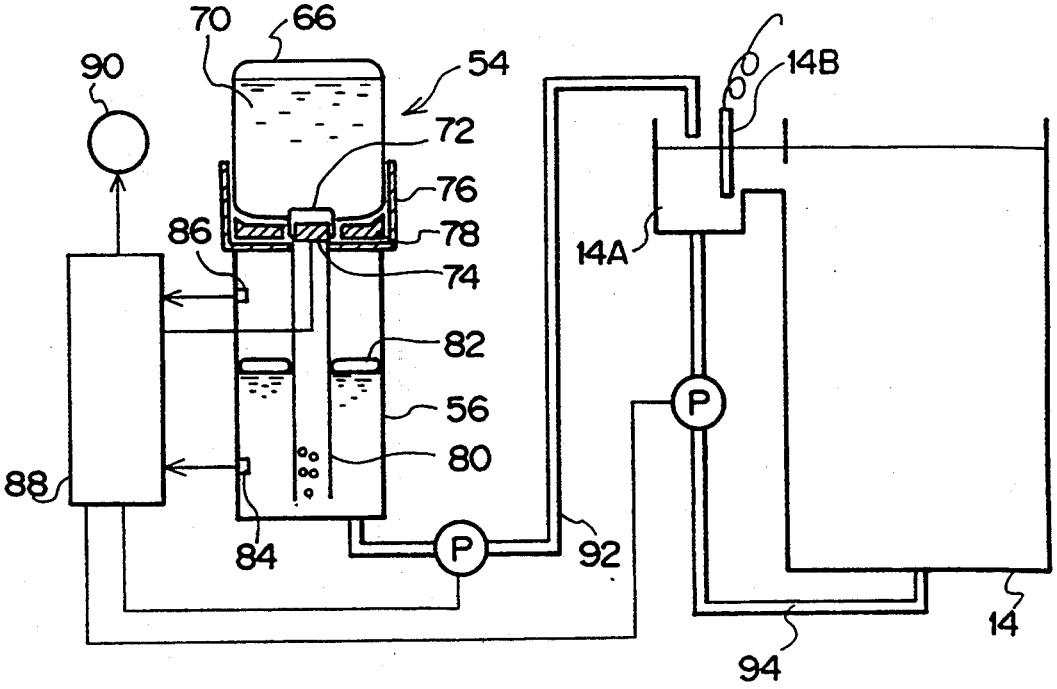
FIG. 5 is a schematic diagram showing a replenisher solution supply apparatus according to a first embodiment of the present invention.

FIG. 5 shows a replenisher supply device 54 which supplies a replenisher to the film developing apparatus 10 and the photographic paper printing and developing apparatus 30. Although the replenisher supply device 54 is provided for each processing tank of the film developing apparatus 10 and the photographic paper printing and developing apparatus 30, in this embodiment, a replenisher solution supply apparatus for the color developing tank 14 is exemplified.

Figure 6:
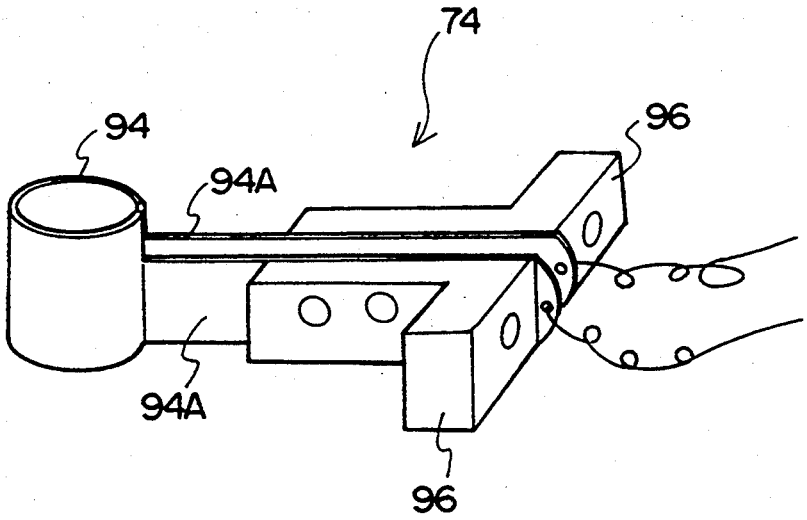
FIG. 6 is a detailed perspective view showing a heater in FIG. 5.

As shown in FIG. 1, the replenisher solution supply apparatus 54 is provided with a replenisher stock tank 56 disposed on a base 10A of the film developing apparatus 10. Reference numerals 14, 16, and 18 in brackets of the replenisher stock tank 56 is reference numeral of a processing tank to which a replenisher is supplied from the replenisher stock tank 56. As shown in FIG. 5, the replenisher stock tank 56 is formed in a rectangular-parallelopiped shape whose upper surface is open. At the opening portion of the replenisher stock tank 56, a bottom mount portion 76 whose upper surface is open is disposed. A flow pipe 80 is disposed so that one end thereof passes through the bottom of the mount portion 76 while the other end is positioned in the vicinity of the bottom of the replenisher stock tank 56. As shown in FIG. 6, a heater 74 is disposed at an end portion on the mount portion side of the flow pipe 80. The heater 74 has a ring-shaped heating portion 94 with a diameter that is substantially the same as the diameter of the flow pipe 80. The ring-shaped treating portion 94 is provided with electrodes 94A and respective holding portions 96. The holding portions 96 are made of an insulating material. The electrodes 94A are electrically connected to a control circuit 88 including a microcomputer or the like.

The cartridge 66 is inserted into the opening of the mount portion 76. The cartridge 66 stocks the replenisher 70 and has a polyethylene lid 72. The cartridge 66 is mounted in such a way that the lid 72 of the cartridge 66 is pressured by the heating portion 94 of the heater 74. A spacer 78 is disposed between the cartridge 66 and the mount portion 76.

On the bottom side of an inner wait of the replenisher stock tank 56, a first solution level sensor 84 (see FIG. 5) which detects the solution level of the replenisher stocked therein is disposed. In addition, on the mount portion side of the inner wall of the replenisher stock tank 56, a second solution level sensor 86 which is similar to the first solution level sensor 84 is disposed.

The first solution level sensor 84 is disposed at a position corresponding to a solution level where the replenisher stock tank 56 requires replenisher (namely, the replenisher stocked in the cartridge 66 must be supplied to the replenisher stock tank 56). On the other hand, the second solution level sensor 84 is disposed at a position slightly below a solution level where the replenisher stocked in the cartridge 66 has been fully supplied to the replenisher stock tank 56. The first and second solution level sensors 84 and 86 are electrically connected to the control circuit 88. An alarm 90 which indicates the need for replacing the cartridge 66 is also electrically connected to the control circuit 88.

In the replenisher stock tank 56, a floating lid 82 is disposed which floats on the surface of the replenisher stocked therein. Since the floating lid 82 prevents the replenisher stocked in the replenisher stock tank 56 from being in contact with the air, the replenisher can, for the most part, be prevented from being deteriorated by the air. One end of a supply pipe 92 having a pump located at an intermediate portion thereof passes through the bottom of the replenisher stock tank 56. The other end of the supply pipe 92 is inserted into the opening of a replenishing tank 14*a* in the color developing tank 14. A circulation pipe 94 having a pump passes through the bottom of the replenishing tank 14A and the bottom of the color developing tank 14 so that the replenishing tank 14A and the color developing tank 14 are connected. These pumps are electrically connected to the control circuit 88. In the replenishing tank 14A, a heater 14B is provided which keeps the temperature of the processing solution stocked in the color developing tank 14 constant.

Figure 7:
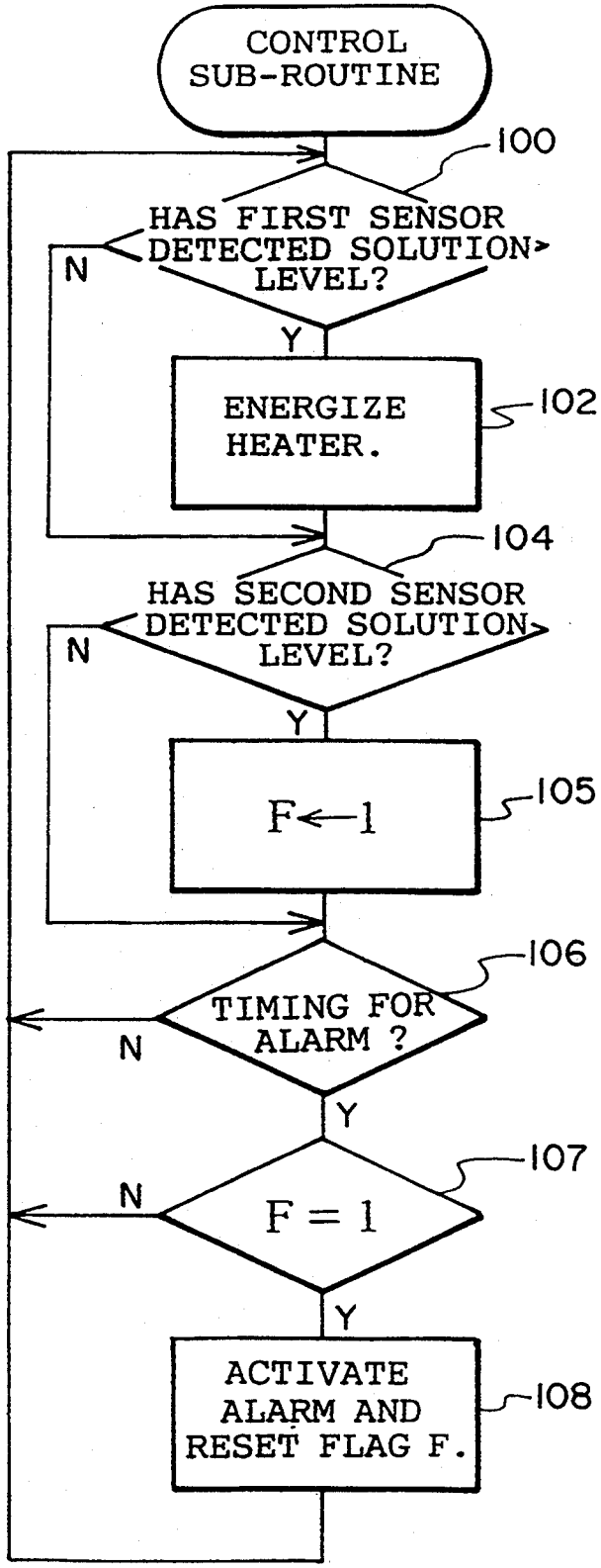
FIG. 7 is a flow chart showing a control routine of a control circuit according to the first embodiment.

Next, with reference to FIG. 7, a control routine of the control circuit 88 will be described.

In an initial state, the replenisher stock tank 56 is filled with the replenisher. Cartridge 66 which stocks the replenisher 70 is mounted on the mount portion 76. When the cartridge 66 is mounted on the mount portion 76, the lid 72 of the cartridge 66 presses the ring-shaped heating portion 94 of the heater 74 at a predetermined pressure. The replenishing amount of the replenisher supplied to the color developing tank 14 depends on the surface areas of the photographic paper and negative film used. At a predetermined timing, a corresponding amount of the replenisher is supplied from the replenishing tank 56 to the color developing tank 14 via the supply pipe 92 and the replenishing tank 14A. When the amount of the replenisher 56 in the replenisher stock tank 56 decreases and runs short, the first solution level sensor 84 detects the solution level of the replenisher. After the first solution level sensor 84 detects the solution level of the replenisher in step 100, the replenisher must be supplied to the replenisher stock tank 56. Therefore, the control circuit 88 causes electricity to flow to the heater 74 in step 102. This causes the heating portion 94 of the heater 74 to heat thereby melting the lid 72 of the cartridge 66. Consequently, a ring-shaped hole is produced. At this time, the replenisher 70 stocked in the cartridge 60 flows downwardly to the replenisher stock tank 56 through the flow pipe 80. At this time, the replenisher to which flows from the cartridge 66 reaches the bottom of the replenisher stock tank 56. However, since the floating lid 82 floats on the surface of the replenisher in the replenisher stock tank 56, the replenisher which flows downwardly to the replenisher stock tank 56 does not splash. Thus, the replenisher is prevented from adhering to and depositing on the inner wall of the replenisher stock tank 56.

When the first solution level sensor 84 does not detect the solution level of the replenisher in step 100 (in other words, the solution level of the replenisher stocked in the replenisher stock tank 56 is higher than the position of the first solution level sensor 84), the routine advances to step 104.

When all the replenisher stocked in the cartridge 66 flows downwardly to the replenisher stock tank 56, the solution level of the replenisher in the replenisher stock tank 56 rises. Thus, the second solution level sensor 86 detects the solution level of the replenisher. When the second solution level sensor 86 detects the solution level in step 104, the cartridge 66 is empty. In this case, the control circuit 88 sets flag F in step 105 so as to store this empty state.

The control circuit 88 determines whether or not the alarm must be activated in step 106. When the alarm must be activated, the control circuit 88 determines whether or not the flag F has been set in step 107 so as to determines whether or not the cartridge 66 is empty. When the cartridge 66 is empty, the control circuit 88 causes the alarm to activate in step 108 so as to issue an instruction or replacing the empty cartridge 66 with a cartridge 66 filled with the replenisher. At this time, the control circuit 88 resets the flag F.

The alarm will be activated in cases such as when the day's work has been completed, the power of the processor is turned on and is being warmed up, and the day's work has been temporarily stopped.

In the above-described embodiment, with the second sensor, the control circuit 88 determines whether or not the cartridge is empty. However, by only the first sensor, the control circuit 88 can determine whether or not the cartridge is empty. For example, when the first solution level sensor has detected the solution level and then a predetermined period of time (equivalent to the period of time for all of the replenisher stocked in the cartridge tank to flow downwardly into the stock tank) elapsed, if another flag is set, the empty state of the cartridge can be stored. Thus, with this flag, the control circuit 88 can determine whether or not the cartridge is empty. When the cartridge is empty, the control circuit 88 can cause the alarm to be activated.

Next, with reference to FIG. 8, a second embodiment of the present invention will be described. For the sake of simplicity, the similar portions as FIG. 5 are denoted by the similar reference numerals and the description thereof is omitted.

Figure 8:
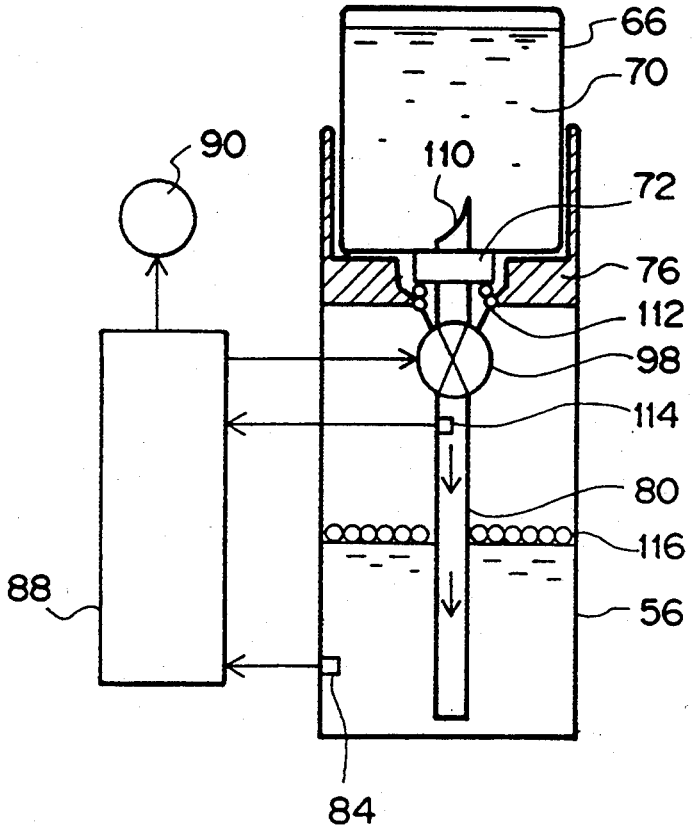
FIG. 8 is a sectional view showing a replenisher stock tank portion of a replenisher solution supply apparatus according to a second embodiment of the present invention.

In the second embodiment, the replenisher solution supply apparatus 54 according to the first embodiment is changed as shown in FIG. 8. At a distal end portion on the mount portion side of the flow pipe 80, a sharp end portion 110 having a blade is disposed. In the middle of the flow pipe 80, a valve 98 is provided. In a through-hole in the mount portion 76 through which the flow pipe 80 passes, a sealing O-ring 112 is disposed. On the downstream side of the valve 98 on the inner wall of the flow pipe 80, a passage sensor 114 which detects the passage of the replenisher is disposed. The valve 98 and the passage sensor 114 are electrically connected to the control circuit 88. In the replenisher stock tank 56, a number of floats 116 floats on the surface of the replenisher in such a way that they are in contact with each other. The floats 116 function in the same way as the floating lid 82 of the first embodiment. The floating lid 82 of the first embodiment may be used instead of the floats 116 in the second embodiment.

In the second embodiment, the cartridge 66 is mounted onto the mount portion 76 in a condition of valve 98 being closed. At this time, the sharp end portion 110 of the flow pipe 80 pierces and passes through the lid 72 of the cartridge 66. Thus, the replenisher 70 in the cartridge 66 flows downwardly from the sharp end portion 110 of the flow pipe 80 to a position upstream of the valve 98. In this state, when the first solution level sensor 84 detects the solution level of the replenisher in the replenisher stock tank 56, the control circuit 88 sends a signal which causes the valve 98 to open. Thus, as with the first embodiment, the replenisher 70 in the cartridge 66 flows downwardly into the replenisher stock tank 56 through the flow pipe 80. At this time, the replenisher which flows downwardly through the flow pipe 80 is detected by the passage sensor 114. If the passage sensor 114 does not detect the flow of the replenisher in the condition of the valve 98 being open. This means that all of the replenisher in the cartridge 66 has flown into the replenisher stock tank 56. At this time, as with steps 104 to 108 in FIG. 7, the control circuit 88 causes the alarm to activate so as to issue an instruction to replace the empty cartridge with a new cartridge filled with the replenisher.

Figure 9:
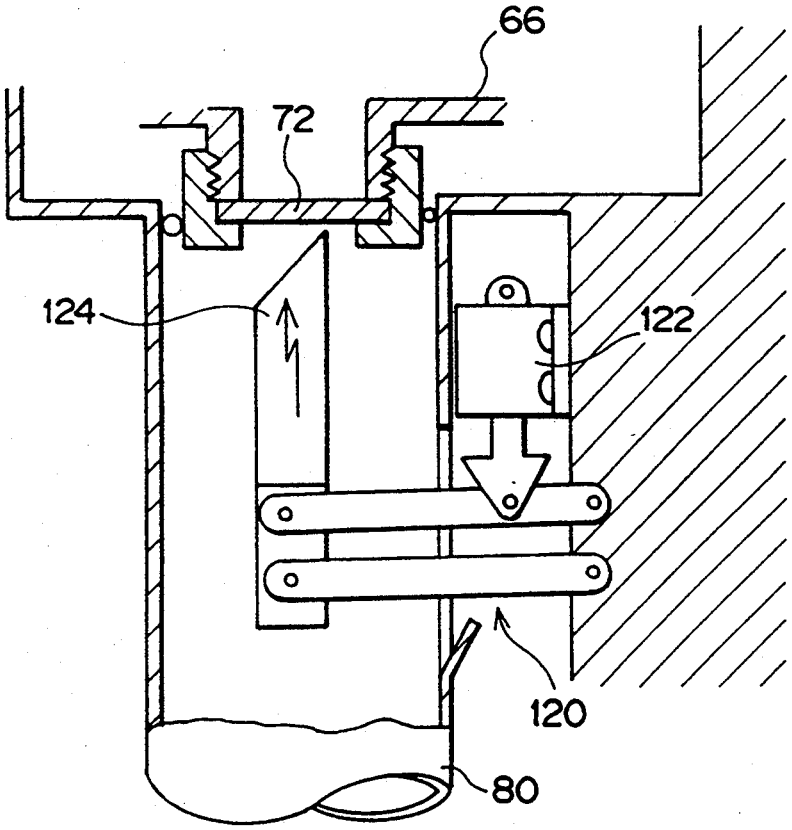
FIG. 9 is a schematic: diagram showing a hole producing mechanism according to a third embodiment of the present invention.

Next, with reference to FIG. 9, a third embodiment of the present invention will be described in detail.

In the third embodiment, a hole producing mechanism which produces a hole in the lid of the cartridge is used instead of the heater 74 used in the first embodiment. As with the first embodiment, the hole producing mechanism causes the replenisher in the cartridge 66 to flow downwardly into the replenisher stock tank 56. For the sake of simplicity, portions similar to the first embodiment are omitted. Therefore, only the hole producing mechanism will be described.

A parallel-link mechanism 120 passes through a side wall of the flow pipe 80 so that one end of the parallel-link mechanism 120 protrudes into the flow pipe 80. In the flow pipe 80, a cylindrical hole-producing blade 124 is disposed at the end of the parallel-link mechanism 120. In the vicinity of an end portion opposite to the hole-producing-blade 124 of the parallel-link mechanism 120, a drive portion of an actuator 122 with a solenoid is disposed. According to the this embodiment, when the actuator 122 is driven, the parallel-link mechanism 120 causes the hole-producing blade 124 to be moved in the direction of the lid 72 of the cartridge 66. With this movement of the hole-producing blade 124, a hole is produced in the lid 72. At the same timing as the heater in the first embodiment is energized, the hole-producing blade 124 is moved and thereby a hole is produced in the lid 72. Thus, as with the first embodiment, the replenisher in the cartridge 66 flows downwardly into the replenisher stock tank 56.

Figure 10:
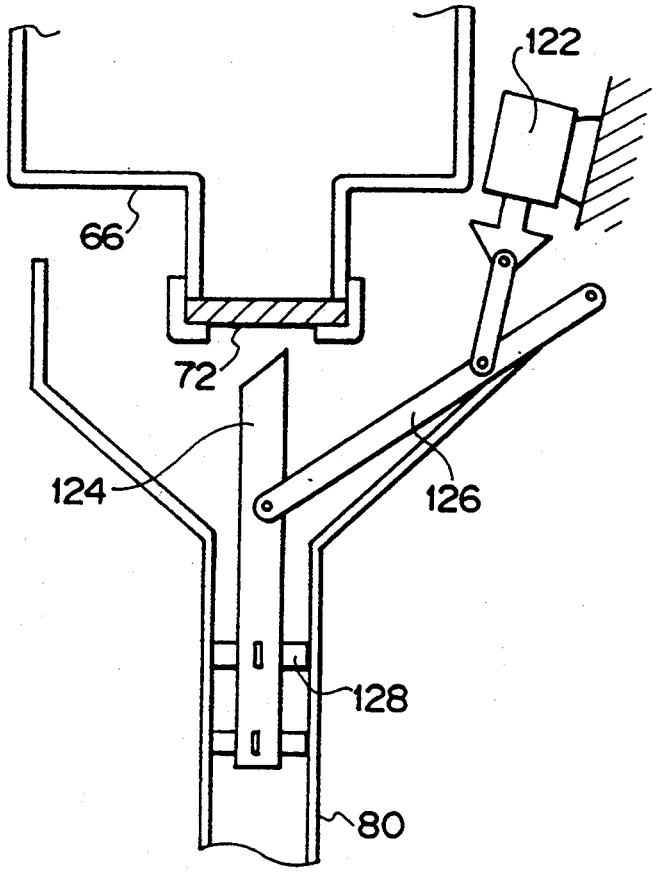
FIG. 10 is a schematic view showing a modified example of the third embodiment of the present invention.

FIG. 10 shows a modified example of the third embodiment. In this modified example, a lever 126 is used instead of the parallel-link mechanism 120 of the third embodiment. A base portion of the hole-producing blade 124 of the third embodiment is inserted into the flow pipe 80. At the base portion of the hole-producing blade 124, a support portion 128 which movably supports the hole-producing-blade 124 along the flow pipe is disposed.

In the above-described embodiments, holes are produced in the lids of the cartridge by melting and by piercing the lids so that the replenisher in the cartridge flows downwardly into the stock tank. However, a lid which is threadably connected to a supply opening of the cartridge may be used. In this case, the lid may be removed so that the replenisher flows downwardly into the stock tank by rotating the lid with a motor or the like.

In these embodiments, the second sensor detects whether or not the cartridge is empty. Instead of the second sensor, a switch may be disposed between the cartridge and the mount portion. The switch may be turned on when the weight of the cartridge reaches a predetermined value or less. Moreover, in these embodiments, the control circuit causes the alarm to activate so as to issue an instruction for replacing the cartridge. Instead of the alarm, timing for the replacement of the cartridge may be instructed by a message on a display portion or the illumination of a lamp.

Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention.

What is claimed is:

1. A replenisher supply apparatus for a photosensitive material processor, comprising:

a cartridge for stocking a replenisher;

a replenisher stock tank having a mount portion for mounting said cartridge and being adapted for stocking the replenisher to be supplied to a processing tank, said replenisher stock tank having contact-area-decreasing means for floating on the replenisher and for decreasing a contact area of the replenisher with air;

a sensor for detecting a solution level of the replenisher in said replenisher stock tank; and flow means for causing the replenisher to flow from said cartridge mounted on said mount portion to said replenisher stock tank when said sensor detects that the solution level is at a predetermined value or below.

2. The replenisher supply apparatus according to claim 1, wherein said flow means has a control circuit connected to an alarm for issuing an instruction for replacement of said cartridge, said flow means being adapted to cause the replenisher to flow from said cartridge to said replenisher stock tank when said sensor detects that the solution level is at the predetermined value or below, and wherein said control circuit determines whether or not said alarm must be activated.

3. The replenisher supply apparatus according to claim 1, wherein the mount portion of said replenisher stock tank is formed in a box-shape with a bottom, the mount portion being adapted to align said cartridge.

4. The replenisher supply apparatus according to claim 1, wherein said flow means has a pipe for causing the replenisher in said cartridge to flow to the bottom of said replenisher stock tank.

5. The replenisher supply apparatus according to claim 1, wherein said contact-area-decreasing means is a float which floats on the surface of the replenisher.

6. A replenisher supply apparatus for a photosensitive material processor, comprising:

a cartridge for stocking a replenisher;

a replenisher stock tank having a mount portion for mounting said cartridge and being adapted for stocking the replenisher to be supplied to a processing tank;

a solution level sensor, disposed on the bottom side of an inner wall of said replenisher stock tank, and being adapted to detect a solution level when the amount of the replenisher in said replenisher stock tank becomes less than a predetermined amount; and flow means for causing the replenisher to flow from said cartridge mounted on said mount portion to said replenisher stock tank when said sensor detects that the solution level has become less than said predetermined amount.

7. A replenisher supply apparatus for a photosensitive material processor, comprising:

a cartridge for stocking a replenisher;

a replenisher stock tank having a mount portion for mounting said cartridge and being adapted for stocking the replenisher to be supplied to a processing tank;

a first solution level sensor and a second solution level sensor, said first solution level sensor being disposed on the bottom surface side of an inner wall of said replenisher stock tank, said second solution level sensor being disposed on the mount portion side of the inner wall of said replenisher stock tank, said first solution level sensor being adapted to detect a solution level when the amount of the replenisher in said replenisher stock tank becomes less than a predetermined amount, said second solution level sensor being adapted to detect a solution level when all of the replenisher stocked in said cartridge is supplied to said replenisher stock tank, whereby said first and second solution level sensors are adapted to detect whether said cartridge must be replaced; and flow means for causing the replenisher to flow from said cartridge mounted on said mount portion to said replenisher stock tank when said first solution level sensor detects that the solution level has become less than said predetermined amount.

8. A replenisher supply apparatus for a photosensitive material processor, comprising:

a cartridge having a meltable portion and being adapted for stocking a replenisher;

a replenisher stock tank having a mount portion for mounting said cartridge and being adapted for stocking the replenisher to be supplied to a processing tank;

a sensor for detecting a solution level of the replenisher in said replenisher stock tank; and flow means for melting said meltable portion of said cartridge and causing the replenisher to flow from said cartridge mounted on said mount portion to said replenisher stock tank when said sensor detects that the solution level is at a predetermined value or below.

9. The replenisher supply apparatus according to claim 8, wherein the meltable portion of said cartridge is a polyethylene lid, and wherein said flow means has a ring-shaped heating portion for melting the lid of said cartridge, the lid of said cartridge being adapted to be pressured against the heating portion of said flow means, the heating portion of said flow means being adapted to heat and melt the lid of said cartridge so as to cause the replenisher in said cartridge to flow into said replenisher stock tank.

10. A replenisher supply apparatus for a photosensitive material processor, comprising:

a cartridge for stocking a replenisher;

a replenisher stock tank having a mount portion for mounting said cartridge and being adapted for stocking the replenisher to be supplied to a processing tank, said replenisher stock tank having contact-area-decreasing means for floating on the replenisher and for decreasing a contact area of the replenisher with air;

connection means for connecting said cartridge mounted on said mount portion to said replenisher stock tank;

a valve disposed at said connection means;

a sensor for detecting a solution level of the replenisher in said replenisher stock tank; and flow means for causing said valve to open and the replenisher to flow from said cartridge mounted on said mounting portion to said replenisher stock tank through said connection means when said sensor detects that the solution level is at a predetermined value or below.

11. The replenisher supply apparatus according to claim 10, wherein said connection means is a flow pipe with a blade, said blade being adapted to pierce said cartridge so as to connect said cartridge and said replenisher stock tank.

12. The replenisher supply apparatus according to claim 10, wherein said flow means has a pipe for causing the replenisher in said cartridge to flow to the bottom of said replenisher stock tank.

13. A replenisher supply apparatus for a photosensitive material processor, comprising:

a cartridge for stocking a replenisher;

a replenisher stock tank having a mount portion for mounting said cartridge and being adapted for stocking the replenisher to be supplied to a processing tank;

connection means for connecting said cartridge mounted on said mount portion to said replenisher stock tank;

a valve disposed at said connection means;

a first solution level sensor and a passage sensor, said first solution level sensor being disposed on the bottom surface side of an inner wall of said replenisher stock tank, said passage sensor being disposed on the downstream side of the valve in said connection means, said first solution level sensor being adapted to detect a solution level when the amount of the replenisher in said replenisher stock tank becomes less than a predetermined amount, said passage sensor being adapted to detect the passage of the replenisher, whereby said first solution level sensor and said passage sensor are adapted to detect whether said cartridge must be replaced; and flow means for causing said valve to open and the replenisher to flow from said cartridge mounted on said mounting portion to said replenisher stock tank through said connection means when said sensor detects that the solution level is at a predetermined value or below.

14. A replenisher supply apparatus for a photosensitive material processor, comprising:

a cartridge having a hole-producible portion and being adapted for stocking a replenisher;

a replenisher stock tank having a mount portion for mounting said cartridge and being adapted for stocking the replenisher to be supplied to a processing tank, said replenisher stock tank having contact-area-decreasing means for floating on the replenisher and for decreasing a contact area of the replenisher with air;

a sensor for detecting a solution level of the replenisher in said replenisher stock tank; and flow means for producing a hole in the hole-producible portion of said cartridge mounted on said mount portion and causing the replenisher to flow from said cartridge mounted on said mounting portion to said replenisher stock tank when said sensor detects that the solution level is at a predetermined value or below.

15. The replenisher supply apparatus according to claim 14, wherein said flow means has a link mechanism having a sharp end which is a cylindrical-hole-producing blade, and an actuator adapted to drive the link mechanism, the actuator being adapted to move the cylindrical-hole-producing blade via the link mechanism so as to produce a hole in the hole-producible portion.

16. The replenisher supply apparatus according to claim 14, wherein said flow means has a pipe for causing the replenisher in said cartridge to flow to the bottom of said replenisher stock tank.

* * * * *